US007744939B2

(12) United States Patent
Greco et al.

(10) Patent No.: US 7,744,939 B2
(45) Date of Patent: Jun. 29, 2010

(54) WEIGHTED INFUSION BEVERAGE PACKAGE

(76) Inventors: Paul V. Greco, 34 Trenor Dr., New Rochelle, NY (US) 10804; Mario Aieta, 100 Hudson St., Apt. 4A, New York, NY (US) 10013

( * ) Notice: Subject to any disclaimer, the term of this patent is extended or adjusted under 35 U.S.C. 154(b) by 1718 days.

(21) Appl. No.: 10/805,695

(22) Filed: Mar. 22, 2004

(65) Prior Publication Data

US 2005/0208181 A1 Sep. 22, 2005

(51) Int. Cl.
*B65B 29/04* (2006.01)
*B65B 29/02* (2006.01)

(52) U.S. Cl. ..... 426/77; 426/78; 426/79; 426/83; 426/132

(58) Field of Classification Search ..... 426/77, 426/78, 79, 433, 435, 80, 82, 83, 132; 206/0.5; *B65B 29/04, 29/02*
See application file for complete search history.

(56) References Cited

U.S. PATENT DOCUMENTS

| | | | | | |
|---|---|---|---|---|---|
| 246,192 | A | * | 8/1881 | Niese | 426/77 |
| 1,428,046 | A | * | 9/1922 | Mock | 99/287 |
| 1,976,497 | A | * | 10/1934 | Higgins | 426/77 |
| 2,137,243 | A | * | 11/1938 | Heyman | 426/77 |
| 2,138,358 | A | * | 11/1938 | Salfisberg | 426/77 |
| 2,193,974 | A | * | 3/1940 | Luckhaupt | 426/77 |
| 2,291,278 | A | | 7/1942 | Cleaves | 99/77.1 |
| 2,291,702 | A | | 8/1942 | Downes | 99/77.1 |
| 2,431,680 | A | * | 12/1947 | Barnett | 426/77 |
| 2,678,000 | A | | 5/1954 | Scheidt et al. | 100/266 |
| 2,791,505 | A | | 5/1957 | Barnett | 99/77.1 |
| 3,126,284 | A | * | 3/1964 | Howerin | 426/77 |
| 3,257,212 | A | | 6/1966 | Kasket | 99/77.1 |
| 3,334,803 | A | * | 8/1967 | Abbey | 426/77 |
| 3,542,561 | A | * | 11/1970 | Rambold | 426/79 |
| 3,809,215 | A | * | 5/1974 | Dobry | 206/0.5 |
| 4,551,336 | A | * | 11/1985 | Chen | 426/83 |
| 4,609,556 | A | * | 9/1986 | Goedert | 426/394 |
| 4,801,464 | A | * | 1/1989 | Hubbard, Jr. | 426/79 |

(Continued)

FOREIGN PATENT DOCUMENTS

FR 2786303 A1 * 5/2000

(Continued)

OTHER PUBLICATIONS

"Tea Rock" Teabag Weight; Internet Ad; Mighty Bean Coffee & Tea Co.; downloaded Mar. 2004.

*Primary Examiner*—Drew E Becker
*Assistant Examiner*—Steven Leff
(74) *Attorney, Agent, or Firm*—Gordon & Jacobson, PC

(57) ABSTRACT

An infusion beverage package includes a body portion having overlying layers of porous material that are joined to form at least one compartment for carrying infusion beverage product in addition to a weight that causes the body portion to sink in water. The compartment(s) may also carry an agent (e.g., sweetener) that imparts flavor characteristics into a solution during steeping of the infusion beverage product. The weight is preferably realized by a non-toxic, insoluble odorless, flavorless microwaveable material (e.g., ceramic material, porcelain material, and naturally-occurring rock material). Alternatively, the weight may be realized by a dissolvable agent such as a sweetener. A multi-compartment single bag design and dual-bag designs are illustrated.

15 Claims, 2 Drawing Sheets

U.S. PATENT DOCUMENTS

| | | | | | |
|---|---|---|---|---|---|
| 4,826,695 | A | * | 5/1989 | Tanner | 426/77 |
| 4,844,914 | A | * | 7/1989 | Bonne et al. | 426/79 |
| 5,047,252 | A | * | 9/1991 | Liu et al. | 426/79 |
| 5,312,318 | A | * | 5/1994 | Vernon et al. | 493/194 |
| 5,552,164 | A | * | 9/1996 | Kuipers et al. | 426/80 |
| 5,554,400 | A | * | 9/1996 | Stipp | 426/78 |
| 5,620,724 | A | * | 4/1997 | Adler | 426/77 |
| 5,672,368 | A | * | 9/1997 | Perkins | 426/83 |
| 6,221,309 | B1 | * | 4/2001 | Kim | 264/632 |
| 6,851,550 | B2 | * | 2/2005 | Bishop et al. | 206/0.5 |
| 2003/0113411 | A1 | | 6/2003 | Rose et al. | 426/77 |

FOREIGN PATENT DOCUMENTS

| | | | |
|---|---|---|---|
| GB | 323436 | | 1/1930 |
| GB | 2247001 | * | 2/1992 |
| WO | WO 92/00031 | | 1/1992 |

* cited by examiner

WEIGHTED INFUSION BEVERAGE PACKAGE

BACKGROUND OF THE INVENTION

1. Field of the Invention

This invention relates broadly to beverage packages. More particularly, this invention relates to infusion beverage packages for tea and coffee and the like.

2. State of the Art

Instant beverages including tea and coffee have become very popular throughout the world. The preparation of these beverages is obtained by the infusion of the dried, powdered, granulated, or shredded tea leaves in a soluble base, typically water. Therefore, it is common to prepare tea by immersion of a porous bag filled with tea into a cup of hot water. The same principle is applicable to other packaged beverages, e.g., bags containing coffee, broth, medicament preparations, etc.

However, when the porous bag is immersed in water, it has a tendency to rise up in the cup due to captured air bubbles and the light density of the materials in the bag. When the porous bag floats to the top of the cup, the rate of steeping of the materials into the cup is reduced. Thus, it is commonplace for users to use a spoon to keep the porous bag totally immersed in the water. This repetitive task is annoying to many users.

It is also known to attach the porous bag to a weighted member that keeps the porous bag totally immersed in the water. U.S. Pat. No. 3,257,212 describes a stick with a plastic pouch that surrounds the stick. A metal weight is integrally attached to the bottom of the stick or the plastic pouch. The porous bag (referred to as an "envelope") is attached to the plastic pouch. This solution is cumbersome and expensive to implement because the weighted member is far bigger than the porous bag to which it is attached.

SUMMARY OF THE INVENTION

It is therefore an object of the invention to provide a package for infusion beverages that remains totally immersed in water and resists any tendency to float.

It is another object of the invention to provide a package for infusion beverages that remains totally immersed in water and that provides a low-cost compact design.

It is also an object of the invention to provide a package for infusion beverages that remains totally immersed in water while providing an increased infusion area.

It is a further object of the invention to provide a package for infusion beverages that is easy to use and effective in infusing product into the beverage.

It is an additional object of the invention to provide a package for infusion beverages that remains totally immersed in water while imparting sweetener or other flavor characteristics to the beverage.

In accord with these objects, which will be discussed in detail below, an infusion beverage package includes a body portion having overlying layers of porous material that are joined to form at least one compartment. The compartment(s) carry infusion beverage product in addition to a weight that causes the body portion to sink in water. The compartment(s) may also carry an agent (e.g., sweetener) that imparts flavor characteristics into a solution during steeping of the infusion beverage product. The weight is preferably realized by a non-toxic, insoluble odorless, flavorless microwaveable material (e.g., ceramic material, porcelain material, and naturally-occurring rock material).

It will be appreciated that with the weight encompassed by the body portion of the infusion package, the body portion sinks and remains totally immersed in the steeping solution, providing more effective steeping of the product held the compartment(s) of the package. Also, the annoying and repetitive task of pushing the bag down with a spoon (or other hand-held element) is avoided, while low-cost compact designs can be realized.

According to one embodiment of the invention, the body portion of the infusion beverage package is realized as a multi-compartment single bag design.

According to another embodiment of the invention, the infusion beverage package is realized as a dual-bag design.

According to yet another embodiment of the invention, the infusion beverage package is realized as a flow-thru dual-bag design.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
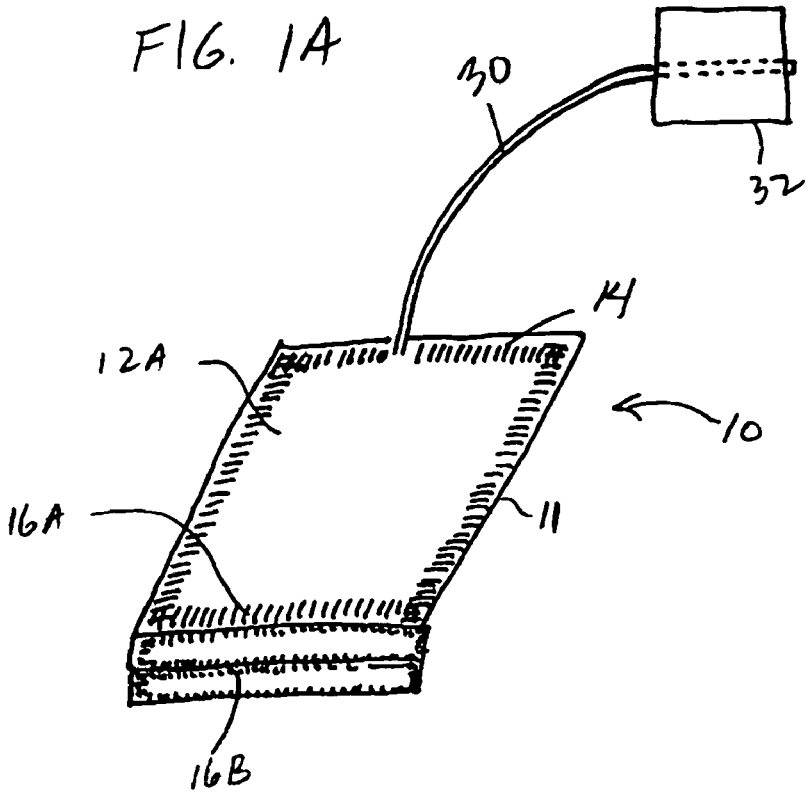
FIG. 1A is a perspective view of a weighted infusion beverage package in accordance with the present invention.
Figure 1B:
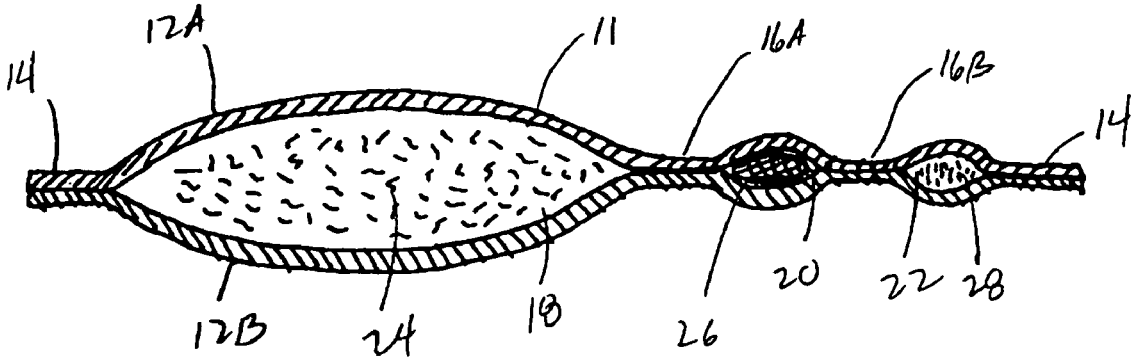
FIG. 1B is a cross-sectional view through the weighted infusion beverage package of FIG. 1A.

Turning now to FIGS. 1A and 1B, there is shown an infusion beverage package 10 in accordance with the present invention. The infusion beverage package 10 has a body portion 11 in the form of a retangularly shaped bag made of suitable filter sheet material. Overlying layers 12A, 12B of the filter sheet material form the sidewalls of the body portion 11 as best shown in FIG. 1B. The marginal area 14 of the overlying layers 12A, 12B along with two transverse sections 16A, 16B of the overlying layers 12A, 12B are joined together, preferably by thermal welding techniques, compression techniques, folding techniques, stitching techniques or in any other suitable manner, to form at least two, and preferably three distinct compartments 18, 20, 22. Details of exemplary techniques for joining together the overlying layers 12A, 12B are set forth in U.S. Patent Application Publication US 2003/0113411 to Rose et al., incorporated by reference herein in its entirety.

The first compartment 18 (or portion thereof) is partially filled with tea 24 (or coffee) before its edges are joined together. Similarly, a weight 26 is disposed in the second compartment 20 (or portion thereof) before its edges are joined, and optionally sweetener product 28 is disposed in an optional third compartment 22 (or portion thereof) before its edges are joined together.

The filter sheet material may be made of fibrous cellulosic material or other material that has sufficient wet strength to withstand immersion into boiling water without damage or disintegration. Moreover, such filter sheet material is sufficiently porous to allow passage therethrough of water for steeping the tea (or coffee) held in the first compartment. Such filter material is non-toxic in addition to being odorless and flavorless such that it does impart odor or taste to the brewed tea (or coffee).

The weight 26 is formed from a non-toxic, insoluble odorless and flavorless material which is relatively more dense than water such that the infusion package 10 sinks when placed in water during steeping. Moreover, it is preferable that the weight 26 be microwave-compatible such that the package 10 can be placed into a cold cup of water that is heated by microwave radiation in a microwave oven without significant degradation. For example, ceramic or porcelain material or naturally occurring rock material (such as lava rock) may be used to form the microwave-compatible weight.

The sweentener product 28 carried by the third compartment 22 is dissolved and infused into the beverage during steeping. In the preferred embodiment of the present invention, the sweetener product 28 contains a predetermined amount (for example, a teaspoon or ½ teaspoon) of sugar. Alternatively, the sweetener product 28 may be a sugar substitute (such as Nutrasweet®, Sweet'N Low®, etc.), honey or other preferred sweetener. The third compartment 22 can also be used to carry agents that provide other flavor characteristics (such as a cream or lemon flavor) to the infused beverage.

In order to facilitate handling of the body portion 11 during (and after) steeping, a string 30 is anchored to the body portion 11 by a staple or stitch, the thermal welding, or other suitable means (not shown). Preferably, the string 30 is anchored to the body portion 11 near the top of the body portion while the weight is disposed near the bottom of the body portion 11 as shown in FIG. 1A. A tag 32 is affixed to the end of the string 30 opposite the body portion. The tag 32 may bear a legend, such as the name (or trademark) of the manufacturer, product name, or other product indicia.

After manufacturing the infusion package 10 as described above, the infusion package 10 may be used to brew a cup of tea (or coffee) by holding the tag 32 with the body portion 11 suspended by the string 30 and immersing the entire body portion into a cup of boiling water. Such boiling water may be provided by microwave heating of the water-filled cup in a microwave oven with the package 10 immersed in the water-filled cup.

Advantageously, the weight 26 contained in the second compartment 20 makes the body portion 11 sink and remain totally immersed in the boiling water, providing more effective steeping of the tea (or coffee) held in the first compartment 18. More specifically, because the body portion 11 remains totally immersed in the boiling water, the rate at which the tea (or coffee) steeps into the boiling water is maximized. Also, the annoying and repetitive task of pushing the bag down with a spoon (or other hand-held element) is avoided.

In an alternate embodiment, the weight 26 may be formed from a dissolvable sweetener having a density greater than water. The sweetener is sufficiently dense such that it acts like a weight when the package 10 is immersed in the cup of water. The sweetener weight may dissolve but not before the tea itself has become sufficiently wet to stay immersed for effective steeping. The sweetener may be a sugar or sugar substitute, and can also incorporate flavoring agents as described above. In yet another embodiment, the dissolvable sweetener weight can be realized with some other dissolvable agent (for example, an agent that imparts a cream flavor). In these alternate embodiments, the weight 26 is microwave-compatible.

Figure 2:
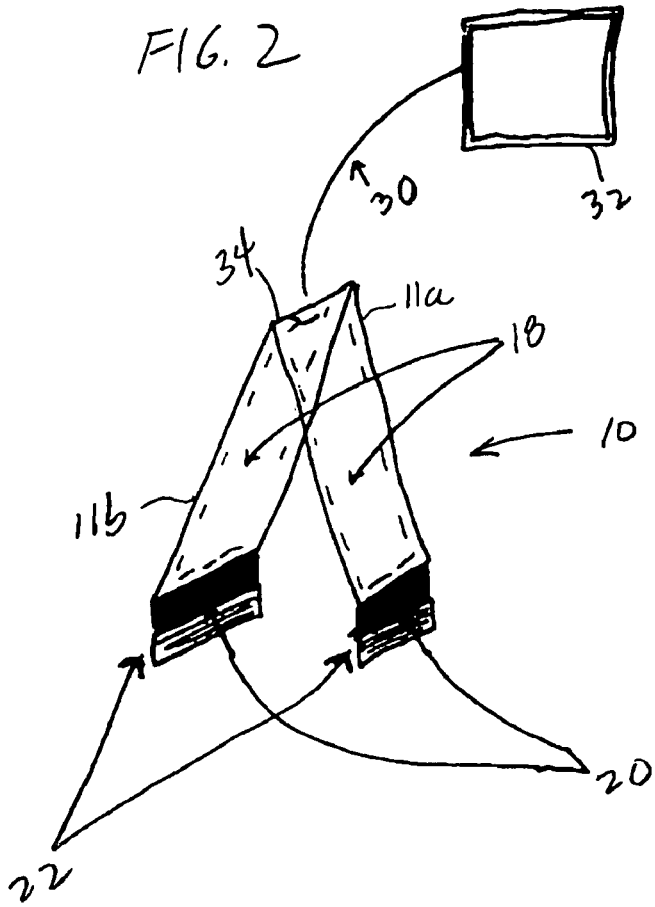
FIG. 2 is a perspective view of a dual-bag infusion beverage package in accordance with the present invention.

FIG. 2 shows an alternate dual-bag design with two body portions 11*a* and 11*b* that extend from a hinged interface 34. Each of the two body portions include at least two (for the tea or coffee and the weight) and preferably all three compartments as described above with respect to the single-bag design of FIGS. 1A and 1B.

Figure 3:
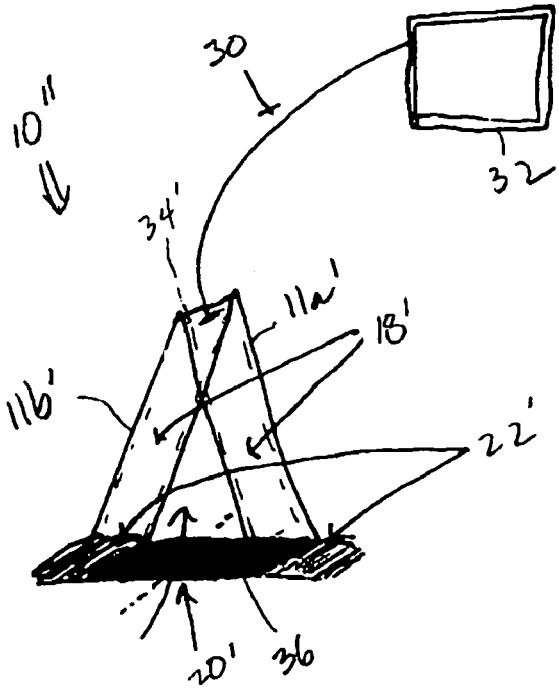
FIG. 3 is a perspective view of an alternate dual-bag infusion beverage package in accordance with the present invention.

FIG. 3 shows yet another dual-bag design. In this embodiment, two body portions 11*a*' and 11*b*' extend from a hinged interface 34'. The body portions 11*a*' and 11*b*' each include a compartment 18' that carries tea (or coffee). The body portions 11*a*' and 11*b*' are joined together by a bottom wall 36, which includes a compartment 20' that holds a weight 28' for the package 10". Extensions of the bottom wall 36 (or extensions of the side walls of body portions 11*a*' and 11*b*) include compartments 22' that hold the sweetener product 28 for the package 10". The area between the body portions 11*a*' and 11*b*' and the bottom wall 26 provide a space for water to flow through the package 10" during steeping and thus provides an increased infusion area. The bottom wall 36 (and possibly the weight 28') may be hinged to permit folding. Such folding provides for encapsulation of the package 10" in a small paper pouch or individual plastic bag.

It is to be understood that this invention is not only applicable to infusion packages for brewing tea (or coffee), but is also adaptable for use with other products encased in a porous sheet material that is immersed into a hot liquid, such as soups, powdered milk, medicinal preparations, food seasonings, dyes and the like.

There have been described and illustrated herein several embodiments of a weighted infusion beverage package. While particular embodiments of the invention have been described, it is not intended that the invention be limited thereto, as it is intended that the invention be as broad in scope as the art will allow and that the specification be read likewise. Thus, while particular shapes and configurations have been disclosed, it will be appreciated that other shapes and configurations can be used as well. For example, and not by way of limitation, it is contemplated that the compartment(s) carrying sweetener (or other flavoring agents) may be omitted from the package (or possibly detachable by tearing along a perforated seam disposed between the second and third compartments). Such configurations would allow the user infuse the beverage without sweetener (or with other sweeteners or flavoring agents so desired by the user). Moreover, it is contemplated that the weight and sweetener product may be carried in the same compartment in the porous filter material. It is also contemplated that the weight and/or sweetener product may be carried along with the infusion product (tea or coffee or other infusion material) in the same compartment in the porous filter material. In yet another configuration, the compartment in the porous filter material that carries the weight may have an opening that allows the user to insert and remove the weight from within the compartment. This feature would allow the weight to be reused over multiple infusion beverage packages if desired. Moreover, while particular configurations have been disclosed in reference to the materials and manufacture of such packages, it will be appreciated that other materials and configurations could be used as well. It will therefore be appreciated by those skilled in the art that yet other modifications could be made to the provided invention without deviating from its spirit and scope as claimed.

What is claimed is:

1. An infusion beverage package comprising:

a body portion comprising overlying layers of porous material that are joined to form at least one compartment, said at least one compartment carrying infusion beverage product in addition to a weight, said porous material of said at least one compartment allowing for passage of water therethrough for infusion of said infusion beverage product carried in said at least one compartment and said weight causing said body portion to sink in water, wherein said weight is realized from the group consisting of ceramic material, porcelain material, and naturally-occurring rock material.

2. An infusion beverage package according to claim 1, wherein:

said at least one compartment carries an agent that imparts flavor into a solution during steeping of said infusion beverage product.

3. An infusion beverage package according to claim 2, wherein:

said agent is selected from the group consisting of sugar and a sugar substitute.

4. An infusion beverage package according to claim 1, wherein:

said overlying layers of porous material are joined together by one of thermal welding, compression, folding or stitching to form said at least one compartment.

5. An infusion beverage package according to claim 1, wherein:

said at least one compartment comprises a first compartment distinct from a second compartment, said first compartment carrying infusion beverage product and said second compartment carrying said weight.

6. An infusion beverage package according to claim 1, wherein:

said weight comprises a material that is non-toxic, insoluble, odorless and flavorless.

7. An infusion beverage package according to claim 1, wherein:

said porous material comprises a sheet of fibrous cellulosic material.

8. An infusion beverage package according to claim 1, wherein:

said porous material withstands immersion into boiling water without damage or disintegration in addition to being non-toxic, odorless and flavorless.

9. An infusion beverage package according to claim 1, further comprising:

a string having a first end opposite a second end, wherein the first end is anchored to said body portion; and a tag affixed to said second end of said string.

10. An infusion beverage package according to claim 9, wherein:

said tag carries product indicia.

11. An infusion beverage package according to claim 1, further comprising:

two body portions that extend from a hinged interface.

12. An infusion beverage package according to claim 11, further comprising:

a bottom wall that extends between the two body portions, said bottom wall and two body portions defining a space for solution to flow through during steeping, and wherein said bottom wall has a compartment for carrying said weight.

13. An infusion beverage package according to claim 12, wherein:

said bottom wall is foldable.

14. An infusion beverage package according to claim 1, wherein:

said infusion beverage product is selected from the group consisting of tea and coffee.

15. An infusion beverage package according to claim 1, wherein:

said infusion beverage product is selected from the group consisting of soups, powdered milk, medicinal preparations, food seasonings, and dyes.

* * * * *